US005176612A

United States Patent [19]

Calvert et al.

[11] Patent Number: 5,176,612

[45] Date of Patent: Jan. 5, 1993

[54] HIGH SPEED ERECTING MECHANISM FOR SLEEVE TYPE CARTON

[75] Inventors: Rodney K. Calvert, Dunwoody; Alton J. Fishback, Austell, both of Ga.

[73] Assignee: The Mead Corporation, Dayton, Ohio

[21] Appl. No.: 808,199

[22] Filed: Dec. 13, 1991

[51] Int. Cl.[5] ..... B31B 5/80; B31B 1/80

[52] U.S. Cl. ..... 493/315; 493/317

[58] Field of Search ..... 493/120, 123, 315, 317

[56] References Cited

U.S. PATENT DOCUMENTS

| | | | |
|---|---|---|---|
| 2,671,385 | 3/1954 | Johenning et al. | 493/315 |
| 3,575,409 | 4/1971 | Calvert | 271/27 |
| 3,599,541 | 8/1971 | Allen | 493/315 |
| 3,783,752 | 1/1974 | Langen et al. | 493/315 |
| 3,991,660 | 11/1976 | Calvert et al. | 93/53 |
| 4,194,442 | 3/1980 | Martelli | 493/315 |
| 4,537,587 | 8/1985 | Langen | 493/315 |
| 4,605,393 | 8/1986 | Krieger et al. | 493/317 |
| 4,625,575 | 12/1986 | Le Bras | 74/63 |
| 5,019,029 | 5/1991 | Calvert | 493/315 |
| 5,054,761 | 10/1991 | Dietrich et al. | 271/95 |
| 5,078,069 | 1/1992 | Dietrich et al. | 493/315 |
| 5,102,385 | 4/1992 | Calvert | 493/315 |

*Primary Examiner*—William E. Terrell

*Attorney, Agent, or Firm*—Rodgers & Rodgers

[57] ABSTRACT

A stack of collapsed sleeve type end loading cartons are disposed in a hopper and the lowermost carton is engaged and fed out of the hopper by a carton pick up device which rotates in one direction. An auxiliary device rotates in the opposite direction from the direction of rotation of the carton pick up device and engages a carton wall so as to move it out of collapsed condition thereby to initiate set up of the carton.

9 Claims, 6 Drawing Sheets

FIG. 2
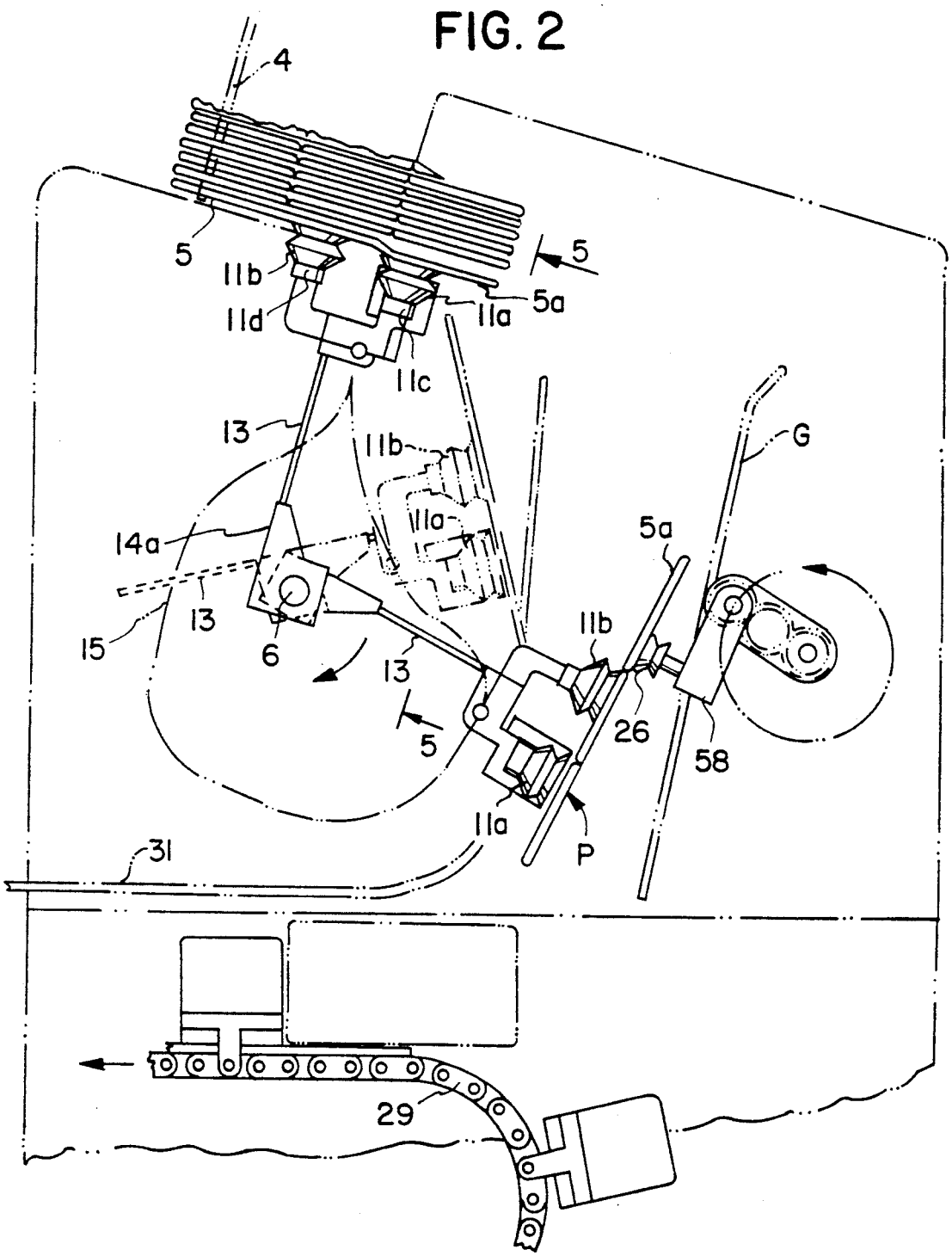
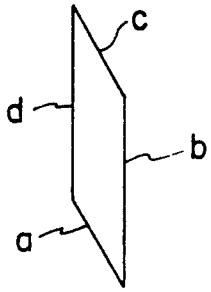
FIG. 2A

HIGH SPEED ERECTING MECHANISM FOR SLEEVE TYPE CARTON

TECHNICAL FIELD

This invention relates to packaging of primary articles such as cans or bottles in sleeve type cartons and is more particularly concerned with feeding such cartons in collapsed condition from a hopper and for initiating a set up operation of the cartons in sequence.

BACKGROUND ART

U.S. Pat. No. 3,575,409 issued Apr. 20, 1971 and owned by the assignee of this invention concerns a carton feeder mechanism wherein motion of the cooperating parts is basically rotary in nature and without sharp and sudden changes in the direction of movement of the parts so as to accommodate high speed operation of the mechanism.

U.S. Pat. No. 3,991,660 issued Nov. 16, 1976 and owned by the assignee of this invention discloses and claims a carton expander mechanism for sequentially manipulating collapsed open ended sleeve type cartons out of a hopper and into set up open ended condition by a main feeder arm for sequentially engaging a lower carton wall to withdraw the associated carton from the hopper together with a supplementary feeder arm pivotally mounted on the main feeder arm and arranged with an end portion thereof adapted to project through an aperture in the lower carton wall so as to engage an upper carton face contacting wall thereby to move such wall away from the lower wall to facilitate setting up the collapsed carton.

U.S. Pat. No. 4,537,587 issued Aug. 27, 1985 discloses and claims a carton opening mechanism in which a first set of vacuum cups withdraws a collapsed carton from a hopper and swings such carton over into firm engagement with a second set of suction cups so as to condition the collapsed carton for a set up operation. In this patent, it would appear that transverse rotary movement of the first set of cups is tangential rather than radial relative to the carton to be picked up and that the cups would tend to slide along the wall of the carton in the hopper and thus might interfere with the appearance of the carton or with the efficiency of the set up operation. In this patent, the second cups do not move in a direction away from the first suction cups in order to set up the cartons.

U.S. Pat. No. 4,605,393 issued Aug. 12, 1986 discloses a carton blank removal erection and transfer apparatus in which a rotatable element is mounted on a shaft which in turn is mounted on an arm which is pivotally mounted at an end thereof remote from the shaft on which the rotatable pick up device is mounted. This arrangement apparently is objectionable because rotation of the suction cups tends to blemish the cartons and to effect an inefficient pick up operation due to sliding movement of the suction cups along the wall of the carton to be picked up.

U.S. Pat. No. 5,019,029 issued May 28, 1991 and owned by the assignee of this invention discloses a carton feeding machine in which carton pick up means is slidably mounted on a support rod secured at one end to a main drive shaft and arranged for its other end to protrude through an opening in one face contacting panel of a collapsed carton so as to engage and move the other face contacting panel in a direction away from the panel in which the opening is formed.

U.S. patent application 664,639 filed Mar. 5, 1991, now U.S. patent 5,102,385 and owned by the assignee of this invention discloses a carton feeding arrangement which withdraws collapsed cartons from a hopper and which swings such withdrawn cartons in an orbital path together with an oscillatory mechanism disposed outside the orbital path for sequentially engaging and moving a panel of a collapsed carton toward open position.

SUMMARY OF THE INVENTION

According to this invention in one form, collapsed sleeve type end loading cartons are withdrawn in sequence from a hopper and moved in an orbital path in one direction about a rotatable shaft and set up is initiated by a mechanism which includes auxiliary rotatable means operable in synchronism with rotation of said rotatable shaft and arranged for orbital movement in the opposite direction of rotation from said one direction of orbital movement of said carton pick up means for engaging the carton so as to initiate a set up operation. The orbital paths of movement about their centers of rotation occur in unison and without appreciable relative movement at the time set up is initiated. This avoids scraping of the carton by the set up cups.

BRIEF DESCRIPTION OF THE DRAWINGS

In the drawings

FIG. 2 is a cross sectional side view of the machine shown in FIG. 1 and which is taken along the line designated 2—2 in FIG. 1;

FIG. 2A is a schematic end view of a partially set up carton;

BEST MODE OF CARRYING OUT THE INVENTION

Figure 1:
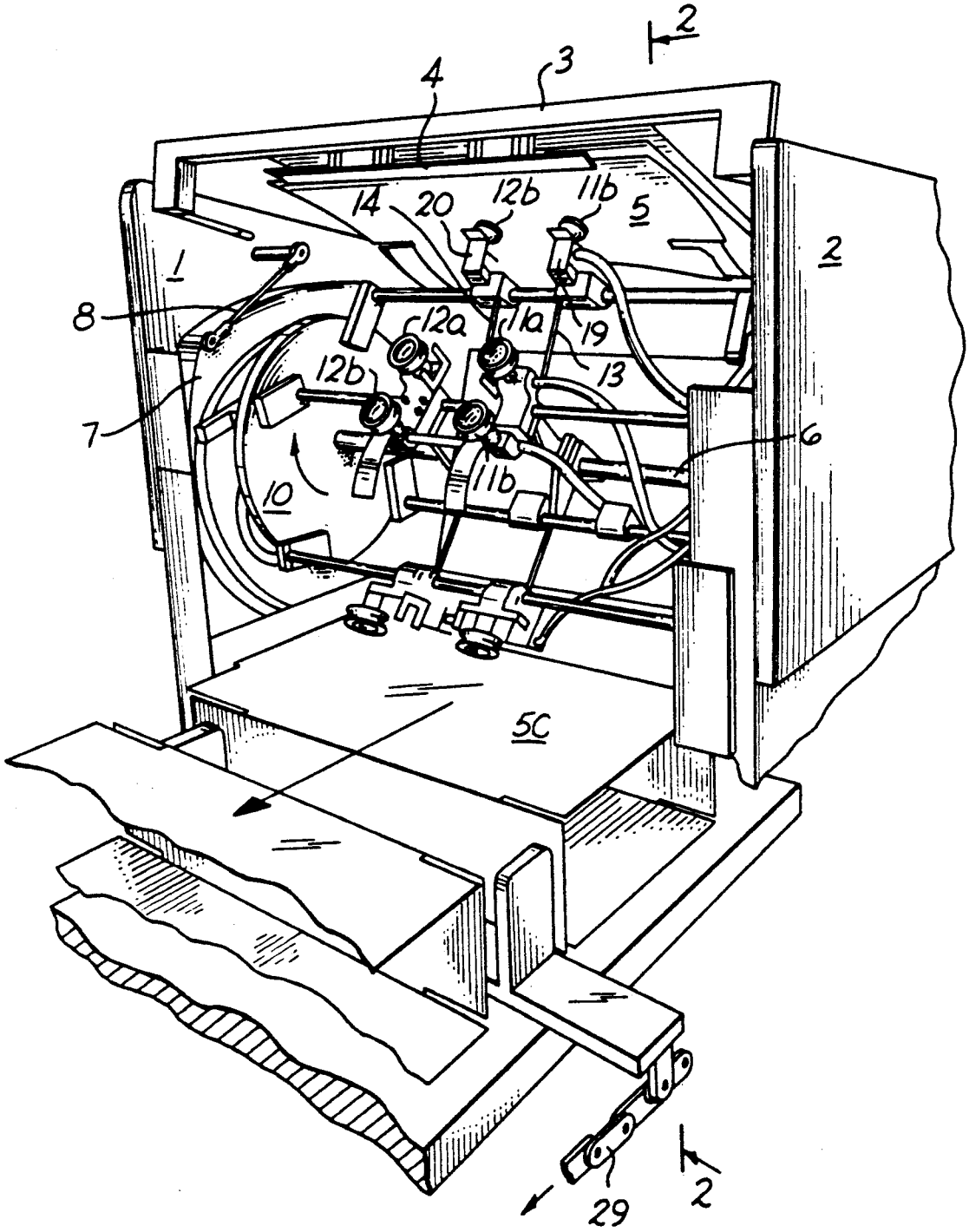
FIG. 1 is a perspective view of a packaging machine constructed according to this invention.

With reference to FIG. 1 parts of a pair of side frame supports 1 and 2 are shown interconnected along their front upper edges by a transverse connecting rod 3; a carton hopper 4 is shown in part with a stack of collapsed open ended cartons disposed within the hopper and the lowermost carton is designated by the numeral 5. A feeder mechanism formed according to this invention includes a main shaft 6 rotatable about a fixed axis and generally supported at its ends in suitable bearing structure not shown but which is conventional and is supported by side frame supports 1 and 2. Suitable conventional driving mechanism is arranged to rotate shaft 6 but is not shown in the drawings. Fixed cam plate 7 is mounted on the inner surface of side frame support 1 and is adjustably positioned on side frame support 1 by a turn buckle designated by the numeral 8. Fixed plate 7 is provided with an aperture having a bearing not shown through which drive shaft 6 extends. A rotatable plate 10 is fixedly secured to drive shaft 6 and is rotatable therewith. Rotatable plate 10 is disposed in close proximity to fixed cam plate 7.

For withdrawing the lowermost collapsed carton such as 5 from the hopper 4, primary cup 11*a* and its associated secondary cup 11*b* together with primary suction cup 12*a* and secondary suction cup 12*b* are provided and slide along support rods 13 and 14 respectively and into engagement with the lowermost carton 5 disposed in hopper 4. These cups as is well understood are mounted on cup holders 11*c* and 11*d*. Support rods 13 and 14 are slidably related with main drive shaft 6 because they are slidably mounted in collars such as 14 which are secured to and rotate with shaft 6. The suction cups and their associated cup holders are guided by suitable cam mechanisms along the cam path designated by the numeral 15 all as explained in more detail in U.S. Pat. No. 4,625,575 issued Dec. 2, 1986 and owned by the assignee of this invention.

In FIG. 2 it is apparent that primary suction cup 11*b* is in closer proximity to the lower most carton 5 than the suction cup 11*a*. This suction cup 11*b* engages the carton 5 as shown in FIG. 2 followed soon thereafter by engagement of suction cup 11*a* with the right hand portion of the lowermost carton 5. This action occurs in rapid fashion and as shown in FIG. 2 suction cup 11*a* withdraws a portion 5*a* of carton 5 downwardly somewhat for a brief period. This action allows any vacuum action between the lowermost carton 5 and the carton immediately thereabove to be dissipated by a flow of air from the atmosphere so that there is no tendency for suction cups 11*a* and 11*b* to withdraw more than one carton from the hopper 4 at one time.

As shown in FIG. 2, continued motion of the suction cups 11*a* and 11*b* is indicated in dotted lines to reach the position designated at P in solid lines. At this point the carton is in fully collapsed condition as shown in FIG. 2.

Figure 5:
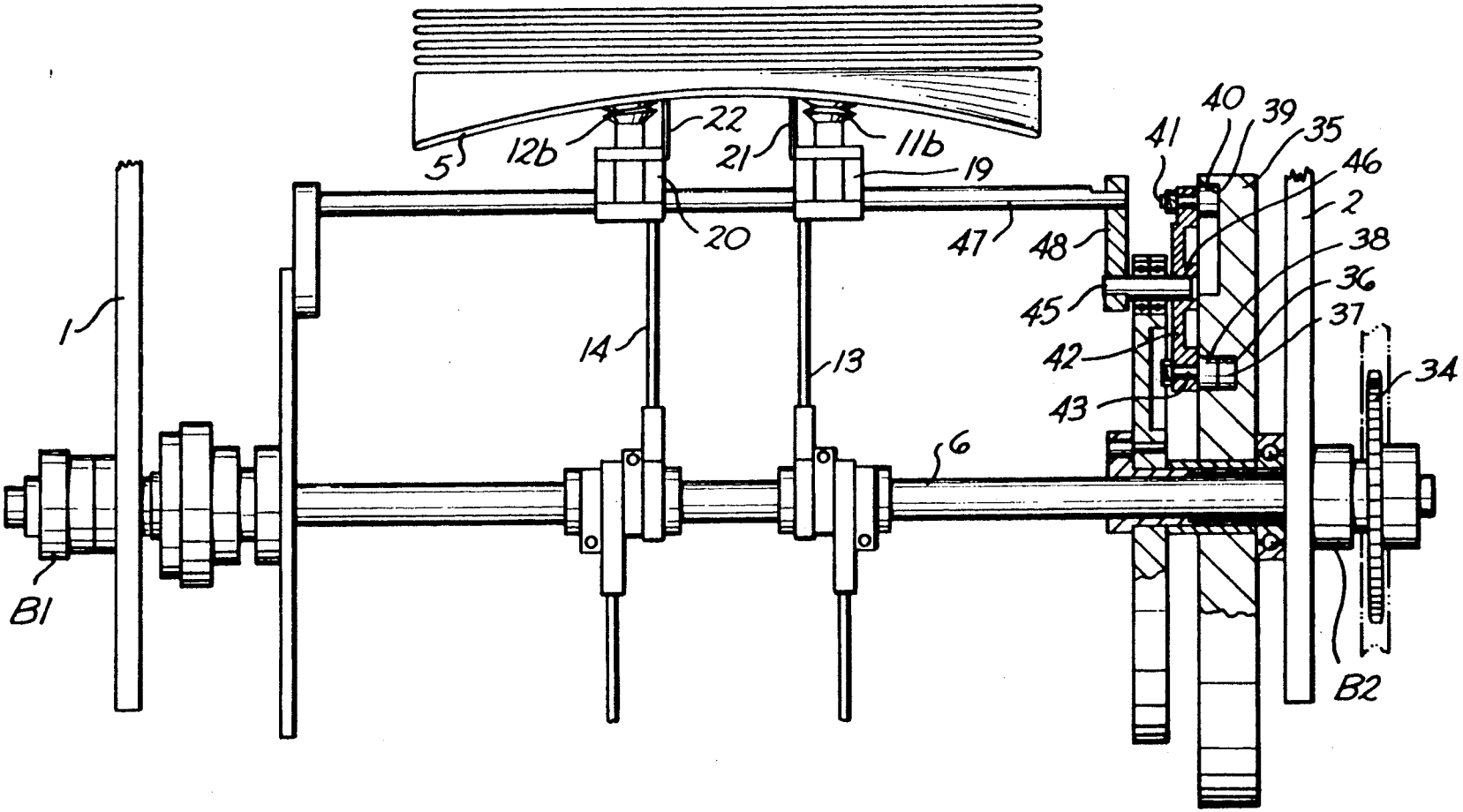
FIG. 5 is an enlarged view taken generally along the line designated 5—5 in FIG. 2.

Since this invention is well adapted for feeding and setting up large collapsed cartons there is a possibility that a premature setting up operation may begin. In order to prevent such premature operation and to secure the blank such as 5 in collapsed condition as long as need be according to one feature of this invention, the carton being fed may be bowed as indicated in FIG. 5 in connection with blank 5. This bowing action is accomplished by abutment members 21 and 22 which are secured to cup holders 19 and 20 respectively. As is apparent in FIG. 5 downward pull by suction cups 11*b* and 12*b* causes the abutment elements 21 and 22 to engage the carton so that continued downward pull of suction cups 11*b* and 12*b* imparts the bowing action to this carton as shown in FIG. 5 so as to insure that the carton will not begin to set up prematurely. Preferably though not necessarily these abutment elements 21 and 22 include a base portion and a pair of upstanding fingers as can be seen in FIG. 1.

Figure 3:
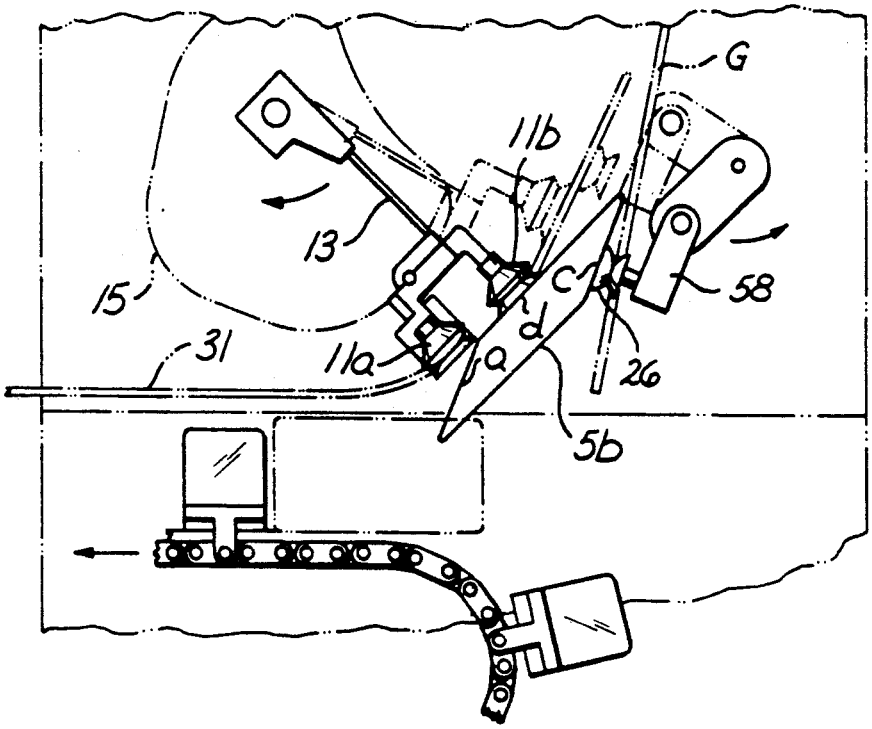
FIG. 3 is a view somewhat similar to FIG. 2 and depicts structure from the lower portion of FIG. 2.
Figure 4:
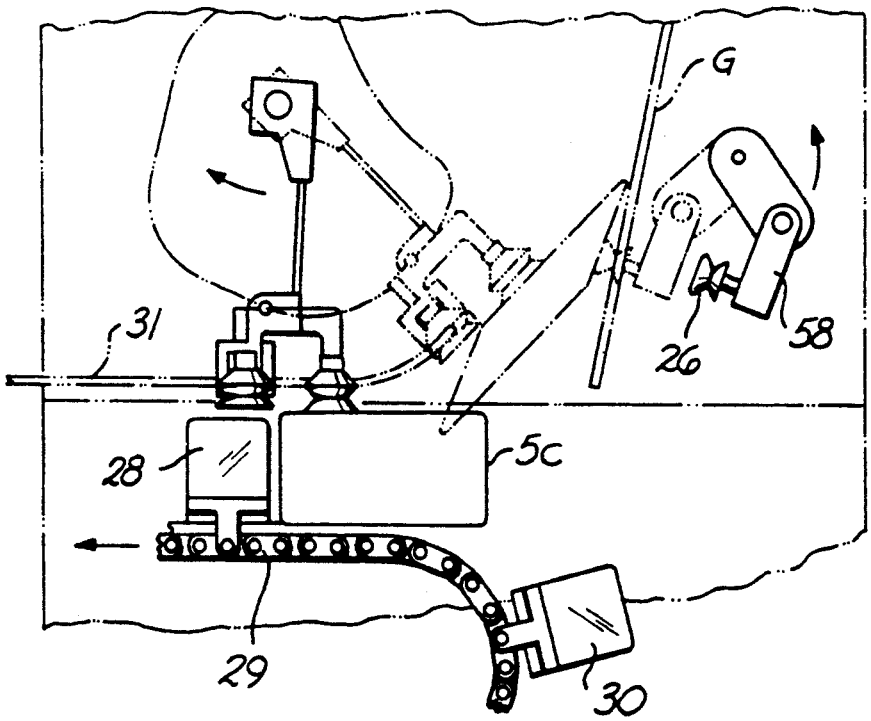
FIG. 4 is a view similar to FIG. 3 but which shows the operative parts in a succeeding stage of a carton set up operation.

With reference to FIGS. 2, 3 and 4, the carton 5 in FIG. 2 is shown at 5*a* prior to the beginning of a carton set up operation. Carton 5 in FIG. 2 is shown in phantom lines in a position which it occupies prior to the position indicated at 5*a*.

Figure 6:
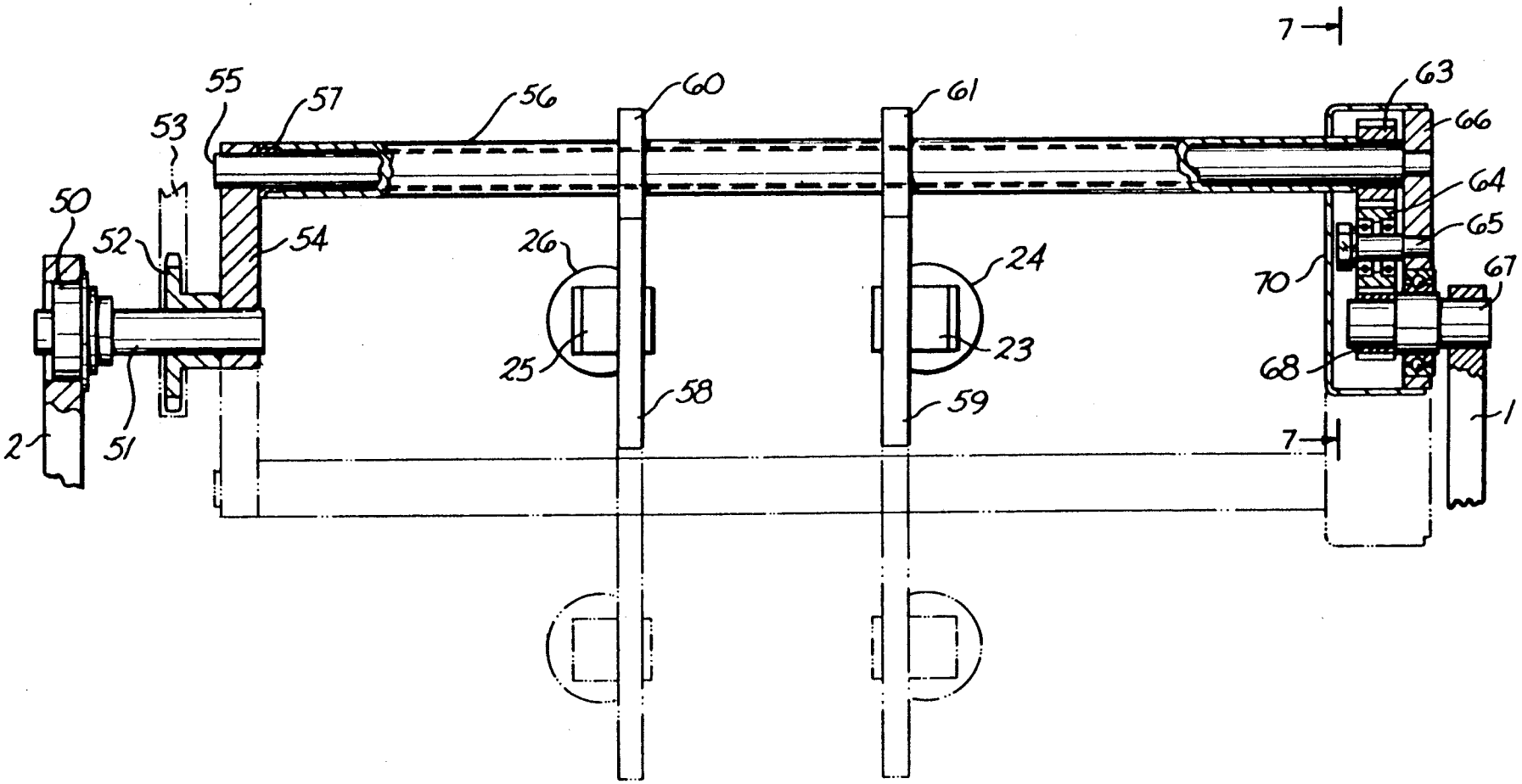
FIG. 6 is an enlarged view taken generally from the right hand side of FIGS. 2, 3, and 4

FIG. 3 shows carton 5 in the position indicated at 5*b* at which time the suction cup 26 and its associated cup 24 as best seen in FIG. 6 have engaged panel C with the carton located as indicated at 5*b* so as to be in the set up operation. At this point primary suction cup 11*b* is in engagement with panel d but suction cup 11*a* has disengaged the carton 5*b* by releasing panel a. A fixed guide G is disposed as indicated in FIGS. 2, 3 and 4 and may contribute to a continuation of the set up operation in order to facilitate a transition into fully set up condition as shown in FIG. 4 where the fully set up carton is indicated at 5*c*. In this position the carton is shown in engagement with conventional flight bar 28 which is mounted on conveyor chain 29 in conventional fashion. As movement of the conveyer chain 29 progresses from right to left, flight bar 30 assumes a position immediately behind the carton 5*c* which is of course then in set up fully opened condition. Contributing to the manipulation of the carton from a position shown in solid lines in FIG. 3 to that shown in sold lines at FIG. 5*c* and FIG. 4, is the guide 31 which is positioned as shown in FIGS. 2, 3 and 4. As is readily apparent, the entry end of the guide is upturned as is apparent in FIGS. 2, 3 and 4.

The structure shown in FIG. 5 imparts operative motion to the structure best shown in FIGS. 1, 2 3 and 4 by virtue of motive means which is conventional and which is designated as a driving sprocket by the numeral 34 which imparts rotary motion to main shaft 6 which as previously indicated is mounted in bearings B1 and B2 supported in apertures formed in side frame supports 1 and 2. Fixed cam plate 35 includes a deep cam track 36 in which a pair of cam followers 37 and 38 are movably mounted and fixed cam plate 35 also includes a shallow cam track 39 in which the single cam follower 40 is disposed. Roller 40 rotates about a stem shaft 41 which is secured to cam bar 42 and cam rollers 37 and 38 are mounted on stem shaft 43 which is mounted on cam bar 42. Cam shaft 45 is rigidly secured at its right hand end to hub portion 46 of cam bar 42 and at its opposite end to cam arm 48.

Cam rod 47 is secured to cam arm 48 and to cup holders 19 and 20. The structure shown in FIG. 5 imparts movement to the cup holders and cups along cam track 15 as is more fully shown in U.S. Pat. No. 4,625,575 issued Dec. 2, 1986 and owned by the assignee of this invention.

Figure 7:
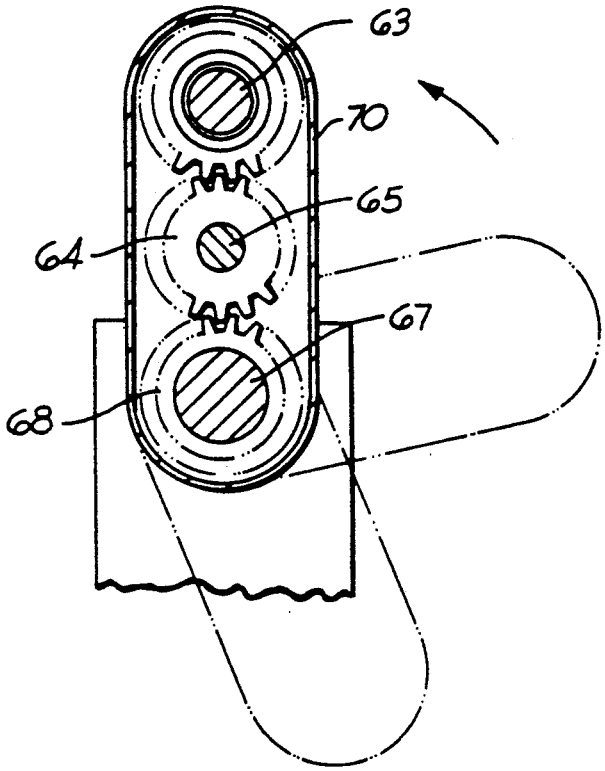
FIG. 7 is a cross sectional view taken along the line designated 7—7 in FIG. 6.

The operation of the suction cups 24 and 26 is best shown in FIGS. 6 and 7. Bearing 50 supports the stub shaft 51 to which sprocket 52 is secured and driven by a suitable mechanism such as a chain 53 and in synchronism with the operation of main shaft 6. Element 54 is rigidly secured to the right hand end of stub shaft 51 and is welded to drive rod 55. Outer tube 56 is disposed about drive rod 55 and is supported at its ends by suitable bearing structure such as a sleeve bearing formed of bronze and indicated at 57 at the left hand end of outer tube 56 and drive rod 55. Arms 58 and 59 are rigidly secured by plate structure 60 and 61 to outer tube 56.

At the right hand side of FIG. 6 the outer tube 56 is rigidly secured to a pinion 63 which cooperates with an idler gear 64 mounted on stub shaft 65 which is mounted on plate 66. Structure designated by the numeral 67 is rigidly secured to side frame 1 and is provided with a pinion 68. If desired pinion 68 and part 67 could be one piece instead of constituting separate parts 67 and 68 as shown.

Rotation of sprocket 52 imparts rotation to the structure which includes stub shaft 51, driving element 54 and the tube rod 55. These elements constitute what amounts to a crank whereby the structure indicated is shown in its lowermost position in phantom lines in FIG. 6. The enclosure for the pinions 63, 64 and 68 is designated at 70. Rotation of drive rod 55 swings the structure of FIG. 7 in a counterclockwise direction as shown in FIGS. 2, 3 and 4. Cooperation of gears 63, 64 and 68 causes rotation of outer tubes 56 about drive rod 55 and swings arms 58 and 59 in a circular path and positions suction cups 24 and 26 as indicated in FIGS. 2, 3 and 4.

Thus according to this invention scraping action of the set up suction cups on the carton is avoided since there is little if any relative motion of the pick up cups and of the set up cups at the beginning of a set up operation.

We claim:

1. A machine for sequentially manipulating out of a hopper a collapsed sleeve type end loading carton and for initiating set up thereof into open ended condition, said machine comprising driving means, a main shaft coupled with said driving means and rotatable about a fixed axis, an elongated support rod having one end thereof slidably mounted on said main shaft and bodily rotatable therewith, carton pick up means fixedly mounted on the other end of said elongated rod for reciprocal movement in a direction which is transverse to said main shaft and for orbital movement in one direction about said main shaft for sequentially engaging the exposed walls of the lowermost carton and withdrawing the lowermost carton from the hopper, auxiliary means rotatable by said driving means in synchronism with rotation of said main shaft for directly receiving a collapsed carton from said pick up means and having a part which is arranged for orbital movement in the opposite direction from said one direction of orbital movement of said carton pick up means for engaging the carton so as to initiate a carton set up operation, said carton pick up means including, a pair of suction cups which engage different ones of said exposed walls of the carton and wherein one of said suction cups initiates withdrawal of the carton from the hopper prior to withdrawal action of the other of said suction cups and said one of said suction cups releases the carton prior to release of the carton by the other of said suction cups.

2. A machine according to claim 1 wherein said auxiliary rotatable means comprises a suction cup secured to an arm which is moved in coordination with rotation of said rotatable means.

3. A machine according to claim 1 wherein said carton pick up means comprises cup holders on which said suction cups are mounted respectively and wherein abutment means is mounted on some of said cup holders for engaging the carton to impart a bowed condition to the carton during its withdrawal from the hopper.

4. A machine according to claim 1 wherein the other of said suction cups is more remote from the hopper than said one suction cup.

5. A machine according to claim 4 wherein said one of said suction cups withdraws a portion of the exposed carton prior to withdrawal of the entire exposed carton thereby to prevent premature withdrawal of the carton which is adjacent to and in contact with said exposed carton.

6. A machine according to claim 1 wherein said auxiliary rotatable means comprises a fixed pinion operable related with an idler pinion which is rotatable about a fixed stud, a tube secured to a third pinion and rotatable with said idler pinion, a driving rod disposed within said tube, crank means arranged to impart circular movement to said driving rod, at least one arm secured to said tube, and a suction cup and cup holder mounted on said arm and movable through a circular path to engage a part of the carton.

7. A machine according to claim 6 wherein said fixed pinion, and said third pinion are the same diameter.

8. A machine according to claim 6 wherein said suction cup and cup holder move in an orbital path to engage a part of the carton while the carton is moved by said carton pick up means.

9. A machine according to claim 6 wherein said crank means comprises said driving rod, a rotatable driving means interconnected with said driving rod by a radial connecting link.

* * * * *